United States Patent [19]

Perkins

[11] Patent Number: 4,953,237

[45] Date of Patent: Sep. 4, 1990

[54] TWO STAGE FLAPPER VALVE FOR FLUID RESERVOIRS

[76] Inventor: Bernard C. Perkins, 920 Avenue "T" SE., Winter Haven, Fla. 33880

[21] Appl. No.: 485,946

[22] Filed: Mar. 1, 1990

[51] Int. Cl.[5] ..... E03D 9/02

[52] U.S. Cl. ..... 4/324; 4/325; 4/392; 4/393; 4/415

[58] Field of Search ..... 4/324–326, 4/392–393, 411, 413, 415, 360, 388, 327, 661, 394, 397

[56] References Cited

U.S. PATENT DOCUMENTS

| | | | |
|---|---|---|---|
| 2,214,439 | 9/1940 | Roberston | 4/394 |
| 2,709,263 | 5/1955 | Doty | 4/325 X |
| 3,987,501 | 10/1976 | Anderson | 4/394 |
| 4,101,986 | 7/1978 | Ng et al. | 4/325 |
| 4,120,056 | 10/1978 | Phripp et al. | 4/324 |
| 4,135,263 | 1/1979 | Anderson | 4/324 |
| 4,138,749 | 2/1979 | Clark | 4/324 |
| 4,275,471 | 6/1981 | Becker | 4/324 X |
| 4,566,140 | 1/1986 | Musgrove | 4/324 |

*Primary Examiner*—Henry K. Artis

*Attorney, Agent, or Firm*—John Gibson Semmes

[57] ABSTRACT

A globular flapper valve for use in combination with a conventional toilet tank. The flapper valve consist primarily of a normally submerged lever-actuated plunger valve having connection with two separate but interconnected air chambers. A first and upper air chamber is formed in a pneumatically sealable globular container, the upper chamber having open drain access to a lower chamber which has access to a reservoir drain. The first air chamber is operatively connected to the plunger valve and the entire unit is controlled by an attached lever which may be selectively actuated to obtain a partial and alternatively a full flush.

2 Claims, 2 Drawing Sheets

FIG. 2
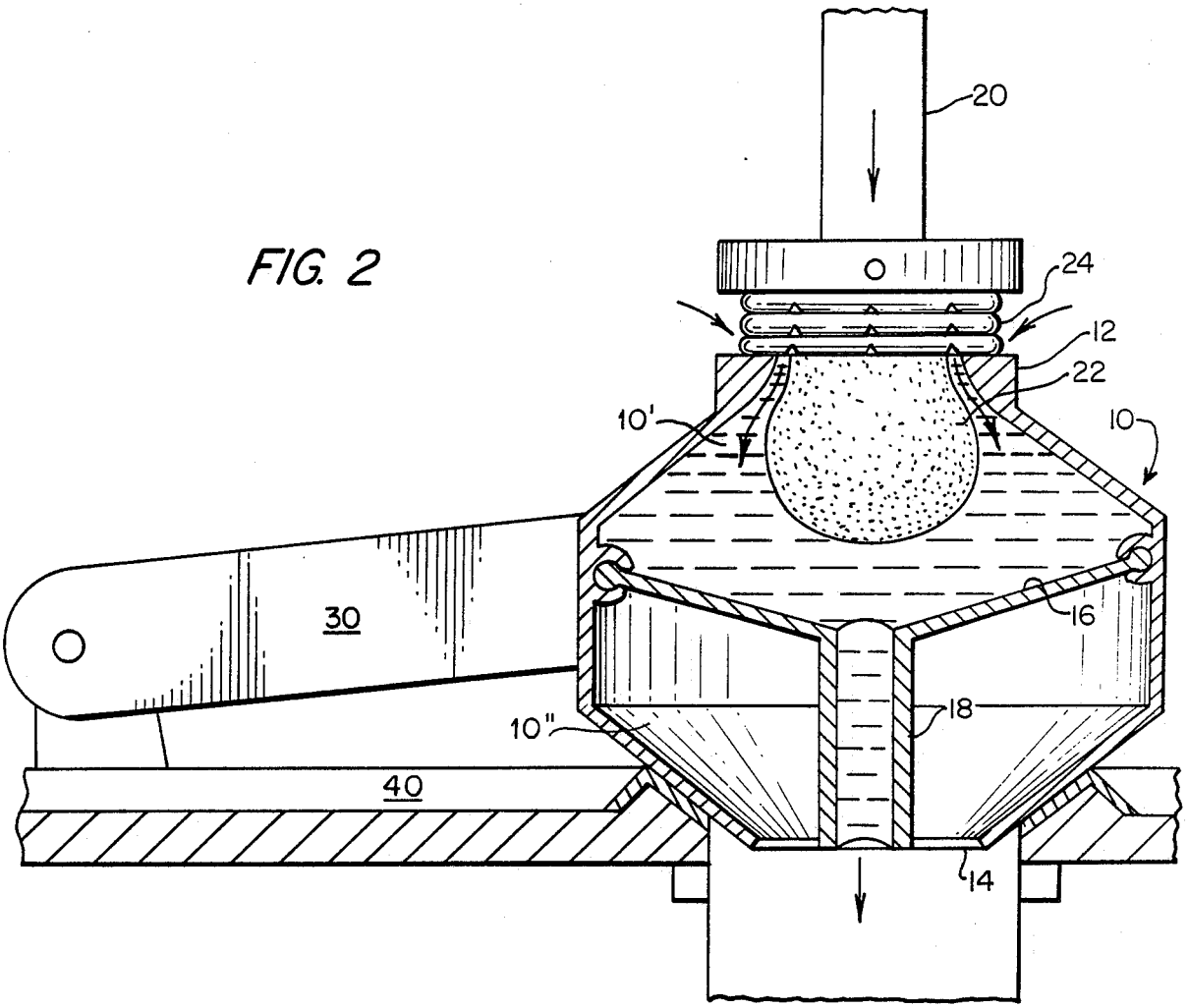
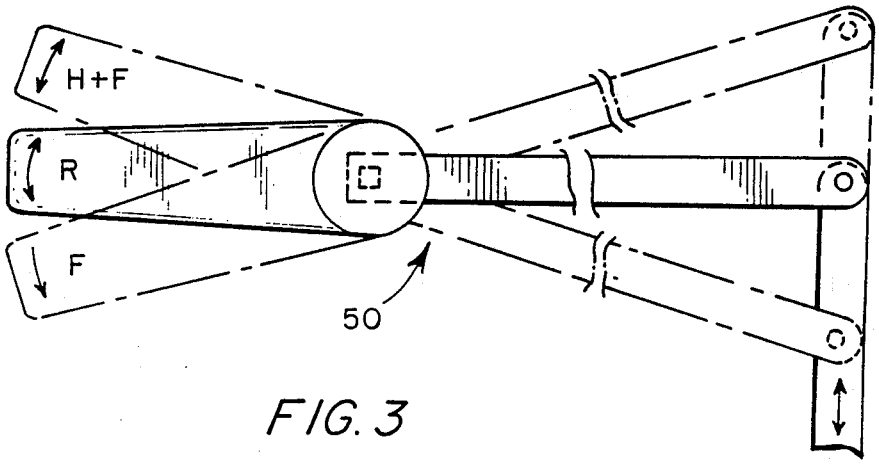
FIG. 3

TWO STAGE FLAPPER VALVE FOR FLUID RESERVOIRS

BACKGROUND OF INVENTION

This invention pertains to a composite valve which may tend to save dispensed water, and in a preferred adaptation, to a dual valve system for the reduction of potable water consumed in flushing a tank top toilet. By this apparatus one may selectively obtain partial and/or full flush. The partial flush insures against avoidable contamination of valuable potable water.

The best known prior art of related systems consists of:

PHRIPP ET AL: 4,135,263
CLARK: 4,138749
CRUMBY: 4,160,294
DETZEN: 4,216,555
ANDERSON: 4,135,263

The present invention is distinguished from the prior art in construction and result as well be apparent from the ensuing specification, drawings and claims.

SUMMARY OF INVENTION

Conventional tank type flushing systems yield a full volume or full flush for both solid and liquid waste disposal. Unfortunately, such systems needlessly contaminate a tremendous quantity of potable water in septic and sewage disposal. The coactive hydraulic and pneumatic valve system employed herein will guarantee reduced water quantity consumed in operating a normal tank top toilet. It is essentially a submerged, pneumatic water displacement system. The user optionally herein controls the volume of water in one or two stages through operating a tank top control crank lever. In the present dual flush system a partial flush of less quantity and force is sufficient to remove liquid waste, per se, with a saving of 1.425 gallons per flush. Alternately, a full flush, when selected may be activated to remove both solid and liquid waste.

The apparatus herein can be readily installed in a conventional toilet tank, inexpensively and without modification thereto. The specific apparatus consists primarily of a normally submerged lever-actuated plunger valve having connection with two separate but interconnected air chambers. A first and upper conical air chamber is formed in a pneumatically sealable globular container, the upper chamber having open drain access to a lower chamber, the latter having access to a reservoir drain. The first air chamber has operative connection with the plunger valve and the entire unit is operatively controlled by an attached lever as will be described hereinafter.

The sequence of steps in operation is thus: For a full flush, the user depresses the toilet crank lever or handle in a conventional manner "R" to remove the entire air filled valve from its valve seat at the base of the toilet bowl, the globular valve being submerged, with combined air chambers, a full flush occurs. This conventional full flush requires no foreknowledge of the optional selectivity. Assuming in the alternative that the toilet tank is filled to capacity, when the toilet crank lever is raised upwardly, to position "H" and "F", a spring-loaded plunger valve at the top of the upper air chamber is depressed and captive air in the top chamber will escape, letting water replace it. The construction of the lower chamber holds the balance of captive air in place. When the toilet crank lever is thereafter immediately depressed, normally the entire unit is lifted from its seat in the bottom of the tank bowl and buoyancy caused by the remaining air will result in a partial flushing action. This effect is caused by reduced air capacity and diminished buoyancy, whereupon hydrostatic pressure forces the entire globular valve back upon its reservoir or tank seat when the water level therein reaches the predetermined halfway gauge or other level. Then the water contained in the top chamber drains out of the central conduit and the unit is ready for another flushing cycle.

Having summarized the invention, attention is now directed to the drawings and ensuing detailed description, wherein:

FIG. 2 is a schematic elevation of showing the apparatus in preparation for its partial flush mode "H" and "F";

FIG. 3 depicts in schematic the position of crank lever wherein "repose", "full" and "half" flush may be selected, optionally.

BRIEF DESCRIPTION OF THE PREFERRED EMBODIMENTS

Figure 1:
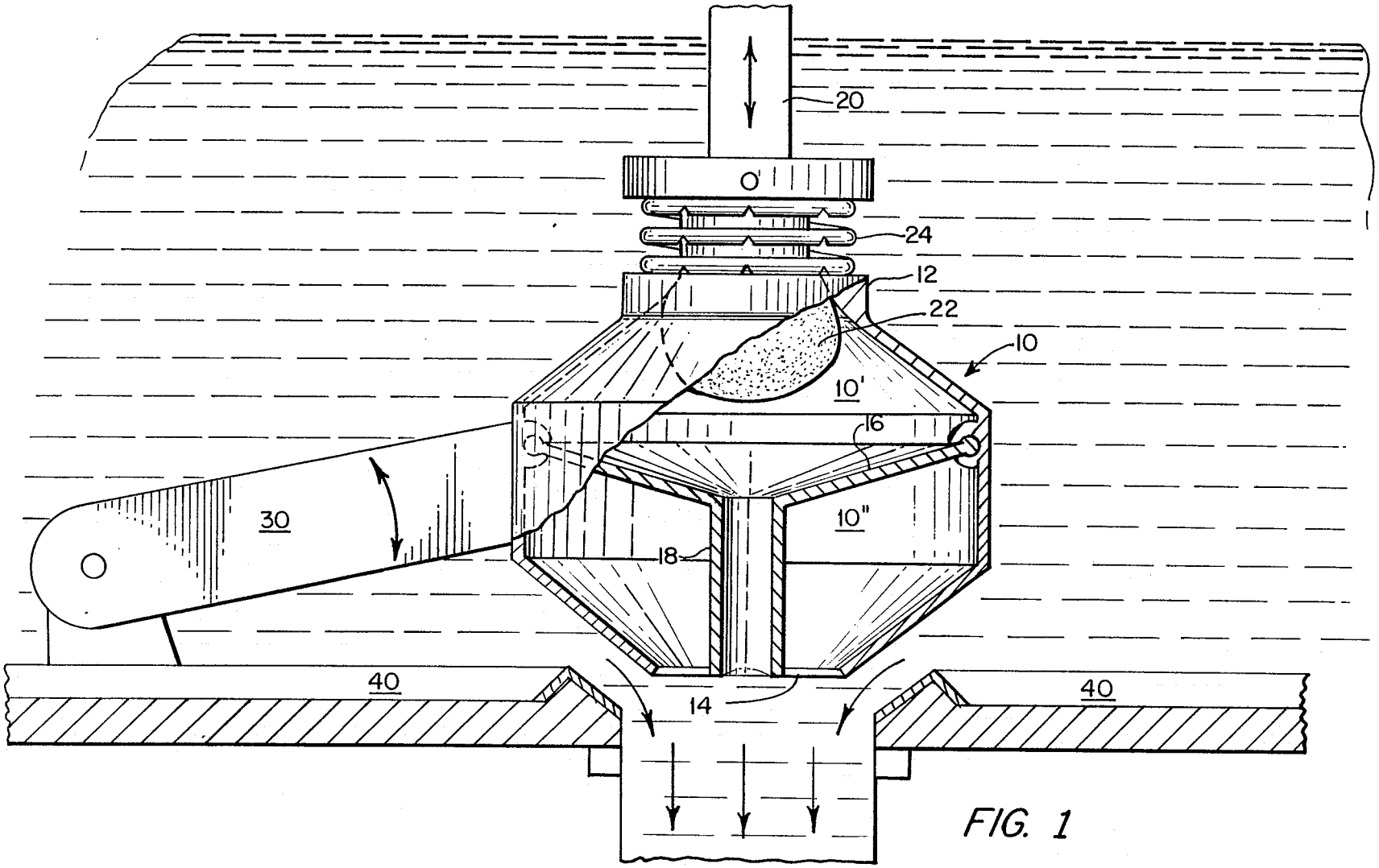
FIG. 1 depicts the invention in schematic elevation, showing the apparatus in its rest mode "R"

A hydraulic flapper type valve flushing apparatus is defined herein. It is characterized by two complementary valves operated by a tank crank lever, to decrease water volume consumption in flushing, in contrast to conventional tank top toilet flushing.

Referring to FIGS. 1 and 2, the main valve 10 defines a globe which is open ended at top 12 and bottom 14. This globe is stabilized by a yoke 30, the yoke being pivotally anchored to the base 40. The valve 10 is divided into chambers 10' and 10''. The bottom of the valve 10 is removably seated in sealable relation to the flushing drain of a conventional toilet bowl. The entire valve unit may be adapted to a conventional system without substantial modification, excepting as to operating crank lever 50. Intermediate the ends of the main valve 10 is a conical chamber divider 16 with depending water drain 18, the lower end of the drain 18 is coterminous with the open bottom 14 of the main valve 10. Mounted upon main valve 10 is rigid connector 20 to which is attached a plunger valve 22, the latter being held in sealed relation to the upper aperture 14 of the main valve by at least one extended compression spring 24. The main valve is adapted to contain captive air in both upper chamber 10' and lower chamber 10'' when submerged in the tank. Captive air is contained in the main valve after flushing, but lacks sufficient buoyancy to unseat the main valve, except by tank crank lever operation. When the unit is submerged, decompression of the plunger valve 22 by lifting the flushing lever to "H" and "F" will simultaneously evacuate the upper chamber of its captive air and fill that void with water. See FIG. 2. This displacement of air at 10' occurs by raising the actuating arm or rigid connector 20. See FIG. 3 "H" and "F".

As indicated previously, if the flushing lever is then immediately depressed to position "F", the entire flapper valve 10 is lifted off its seat, whereupon by the combination of diminished air capacity and consequent reduction of buoyancy, hydrostatic pressure forces the entire unit back down upon the tank seat. This occurs when the reservoir of water reaches a predetermined level which may be gauged at half the capacity of the tank. Clearly, the volumetric displacement of flapper valve 10, relative to the reservoir tank will determine the "gauge" or quantity of water thus saved. At this point, the water contained in the top chamber 10' automatically drains out the channel 18 of the tank drain. The remaining captive air in the lower chamber 10'' being constant is retained therein and the unit being reseated with both air chambers filled, is ready for a new cycle of operation.

I claim:

1. In combination with a fluid reservoir, defining a valve seat at its bottom and bearing an operating crank lever which is pivoted to a wall of the reservoir;

(a) a normally submerged globular flapper valve, movably engaging the reservoir in hermetically sealed relation to the reservoir valve seat, said flapper valve having open ends at top and bottom and interconnected top and bottom chambers, wherein the topmost chamber defines a drain extending centrally through the bottom chamber, the drain being coterminous at its end to the open end of the bottom chamber of said flapper valve;

(b) a normally submerged secondary spring-loaded plunger valve, compressibly mounted upon the flapper valve and having engagement with said crank lever, said plunger valve being adapted to engage the open top of the flapper valve in hydraulically sealable superposition relative to the top chamber of said flapper valve;

(c) said operating crank lever operably engaged with the secondary spring-loaded plunger valve by a substantially rigid connector, said crank lever being operable from an intermediate position of repose "R", to a depression position whereby said flapper valve is moved from said valve seat for a full flush "F" and to a combination lift position "H"+"F", wherein said plunger valve is moved from said open top end to relieve air from the top chamber to be replaced with water via said drain thereby reducing the buoyancy of said flapper valve, and sequential depression of the crank lever to position "F", and upon immediate release of the crank lever from position "F", a half flush of the fluid reservoir is effected.

2. The combination of claim 1 including a base member interconnecting the reservoir valve seat and a bottom portion of the reservoir, said base member pivotally mounting a yoke, the yoke having stabilizing connection with the globular flapper valve.

* * * * *